US008516645B2

(12) United States Patent
Kraemer

(10) Patent No.: US 8,516,645 B2
(45) Date of Patent: Aug. 27, 2013

(54) DEVICE

(75) Inventor: Hans Kraemer, Baden (DE)

(73) Assignee: GlaxoSmithKline Consumer Healthcare GmbH & Co., Buehl (Baden) (DE)

( * ) Notice: Subject to any disclaimer, the term of this patent is extended or adjusted under 35 U.S.C. 154(b) by 308 days.

(21) Appl. No.: 12/442,079

(22) PCT Filed: Sep. 20, 2007

(86) PCT No.: PCT/EP2007/059925
§ 371 (c)(1),
(2), (4) Date: Mar. 19, 2009

(87) PCT Pub. No.: WO2008/034858
PCT Pub. Date: Mar. 27, 2008

(65) Prior Publication Data

US 2010/0017989 A1 Jan. 28, 2010

(30) Foreign Application Priority Data

Sep. 22, 2006 (GB) ..... 0618750.4

(51) Int. Cl.
*A46B 7/06* (2006.01)

(52) U.S. Cl.
USPC ..... 15/201

(58) Field of Classification Search
USPC ..... 15/167.1, 201, 198, 22.1, 22.2
See application file for complete search history.

(56) References Cited

U.S. PATENT DOCUMENTS

| | | | | |
|---|---|---|---|---|
| 5,184,368 | A * | 2/1993 | Holland | 15/167.1 |
| 5,546,626 | A | 8/1996 | Chung | |
| 2005/0011024 | A1* | 1/2005 | Ping et al. | 15/22.1 |
| 2007/0271717 | A1* | 11/2007 | Clos et al. | 15/167.1 |

FOREIGN PATENT DOCUMENTS

| | | |
|---|---|---|
| WO | WO93/02591 | 2/1993 |
| WO | WO00/60980 | 10/2000 |
| WO | WO2004/008248 | 1/2004 |
| WO | WO2005/013762 | 2/2005 |
| WO | WO2005/084486 | 9/2005 |
| WO | WO2005/107522 | 11/2005 |

* cited by examiner

*Primary Examiner* — Robert Scruggs
(74) *Attorney, Agent, or Firm* — Joshua C. Sanders; Theodore R. Furman

(57) ABSTRACT

A toothbrush head having a bristle carrier, and bristles held in bristle holders, the bristle holders being connected to the bristle carrier by resilient connectors which cause the holders to move resiliently as brushing pressure is applied to the bristles and also cause the bristle holders to rotate. A suitable form of connector follows a conical surface between the bristle holder and bristle carrier.

11 Claims, 4 Drawing Sheets

DEVICE

This application is a §371 national phase entry of International Application No. PCT/EP2007/059925, filed Sep. 20, 2007.

This invention relates to toothbrushes.

Toothbrushes are well known devices, generally comprising an elongate handle with at one end a head bearing oral cleaning elements such as bristles, e.g. bristle filaments disposed in tufts, to clean such oral surfaces as the teeth and gums. Herein the term "bristles" is used to describe all types of oral cleaning elements, encompassing in particular bristle filaments, the most widely employed form of oral hygiene element. Numerous constructions of toothbrush head are known. WO-A-2000/60980, WO-A-2004/008248, WO-A-2005/084486, WO-A-2005/107522 and WO-A-2005/013762 are among many disclosures of toothbrushes in which the bristles are mounted on a bristle carrier which comprises an elastic pad.

Toothbrushes in which the bristles are mounted on a bristle carrier being an elastic pad need to be improved and optimised. It is an object of this invention to provide an improved toothbrush with its bristles mounted on a bristle carrier which comprises an elastic pad. Other objects and advantages of this invention will be apparent from the following description.

According to this invention a toothbrush head comprises a bristle carrier having an upper surface, a bristle holder holding one or more bristle, the bristle being elongate along a bristle longitudinal direction and having an upper end relatively distant from the bristle carrier and a lower end relatively nearer to the bristle carrier, a connector connecting the bristle holder to the bristle carrier, the connector being resiliently flexible in a direction such that:

pressure applied to the bristle in the bristle longitudinal direction toward the bristle carrier causes the bristle holder to move downwards in the bristle longitudinal direction and to rotate in a first rotation direction around a rotation axis parallel to the bristle direction, and subsequent release of the pressure causes the bristle holder to move reciprocally upwards in the opposite direction, and to rotate in a second rotation direction around a rotation axis parallel to the bristle direction and opposite to the first rotation direction.

As used herein "upward" and "downward" and related terms are used in relation to the direction in which the upper surface of the bristle carrier faces. Obviously the toothbrush head may be held in any orientation for use.

Preferably the bristle comprises a bristle filament, e.g. of generally conventional type, and plural bristles are bundled together with their longitudinal directions generally aligned, in a tuft of bristle filaments.

The holder may comprise a cup in which the bristle, e.g. a tuft of plural bristle filaments sit. Alternatively the holder may comprise a sleeve through which the bristle, e.g. a tuft of plural bristle filaments is threaded and in which the bristle is fixed.

Preferably there are plural connectors i.e. two or more, e.g. three to five connectors. Plural connectors are preferably arranged regularly around the circumference of a circle centered on the rotation axis.

Preferably the connector follows a non-radial path relative to the said rotation axis.

Preferably such a connector which follows a non-radial path relative to a central longitudinal axis of the bristle follows a curved path.

Such a connector which follows a curved path may follow a helical path. The twist axis of such a helix may for example be aligned at an angle 0 to 45° to the alignment of the bristles.

Preferably such a connector which follows a non-radial path relative to a central longitudinal axis of the bristle follows a path which follows a conical surface, with an end of the connector connected to the bristle holder being nearer to the apex of the conical surface, and an end of the connector connected to the bristle carrier being nearer to the base of the conical surface.

A suitable form of the connector is a form having a length dimension along the bristle holder-carrier direction, and width and thickness directions perpendicular to this length direction, and width and thickness dimensions less than the length dimension. The cross-section of such a connector cut across its length direction may be anything convenient, e.g. circular, oval, rectangular etc. An example of such a form is a strip.

There is preferably a base connected to the bristle carrier, and the connector(s) connect(s) the bristle holder to the base, so that the connection of the connector(s) to the bristle carrier is via the base. Suitably the base may be ring or polygon shaped (circular or otherwise) centered on the bristle central longitudinal axis. Alternatively for example the base may comprise a foot to which the end of the connector remote from the bristle carrier may be connected. For example there may be one such foot per connector.

Preferably the holder and the connector(s) are integrally made of a resilient plastics material such as the kind of plastics material commonly used for toothbrushes, such as polypropylene. If a base is present this too may be integrally made of the plastics material.

Holders of the above-described type when made of such plastics materials can easily hold bristle tufts, e.g. by being moulded around the ends of the bristle tufts or having a cavity therein into which the ends of tufts may be fixed by for example small metal "anchors" of the types conventionally used to fix bristle tufts into the heads of conventional toothbrushes. Connectors of the above-described type made of the described plastics materials, in dimensions suitable for inclusion into the typical surface area of a toothbrush head, can have suitable resilient flexibility to enable the bristle holder to perform the above-described motions. Bases of the above-described type can provide a secure anchorage of the connector in the bristle carrier, and can help to spread the forces transmitted via the bristles to the bristle carrier.

The bristle carrier comprises a part which carries plural bristles, typically plural bristle tufts. In one embodiment the bristle carrier may comprise a conventional toothbrush head, e.g. a rigid plastics material carrier connected to the toothbrush handle.

In such a construction the base may be fixed to such a bristle carrier by known means for example welding, or for example by moulding of the bristle carrier around the bases, or the bases (and preferably consequently the connectors and holders too) may be integrally made with the bristle carrier.

In another embodiment the bristle carrier may comprise an elastic material to which the connector(s) connect the bristle holder. Such an elastic pad may for example be of the type disclosed in the above-mentioned state of the art. Suitably such an elastic material may be a thermoplastic elastomer (TPE) material. An example of a bristle carrier comprising such a material may comprise a pad of such a material, having an upper surface generally perpendicular to the bristle longitudinal direction, and the connector(s) connecting the holder to the pad, e.g. via a base connected to the pad, such that the bristle extends with its longitudinal direction generally perpendicular to the upper surface of the pad.

The connector(s) may support the bristle holder above an upper surface of the bristle carrier made of rigid plastics material to allow the above-described motions of the bristle holder.

The bristle holder may be covered by a layer of or be embedded in an elastic material, for example the elastic material of such a pad, which may be sufficiently elastic to allow the covered embedded holder to move in the manner described above. This covering or embedding can help to prevent contamination of the area between the connectors.

There may be a cavity in the bristle carrier, e.g. in such a pad, adjacent to the holder to facilitate the movement of the holder as described above, relative to the bristle carrier. For example in the case of connectors which follow a conical path and hence the holder is supported above the base of the conical surface, such a cavity may be positioned beneath the bristle holder such that the bristle holder can descend into the cavity as the bristle holder moves toward the bristle carrier in the bristle longitudinal direction. For example the holder may be mounted within the cavity and the connector(s) may connect the holder(s) to the sides of the cavity so that the movement of the bristle holder may occur within the cavity. Such constructions such a cavity can prevent the holder being excessively high above the surface of the bristle carrier.

A bristle carrier made of such an elastic material may itself be supported by a frame, e.g. a plastics material frame. An example of such a frame is for example the feature described as "support 16" in WO-A-2005/084486.

The invention further provides a toothbrush provided with a toothbrush head as described above. Such a toothbrush may be an otherwise conventional manual toothbrush having a grip handle connected to the head. Such a toothbrush may be a powered toothbrush in which the head is moved in a brushing motion by an electric motor.

Other features of a toothbrush provided with a head as described herein may be generally conventional, e.g. as known or disclosed in the toothbrush art.

The invention will now be described by way of example only with reference to the accompanying drawings.

Figure 1:
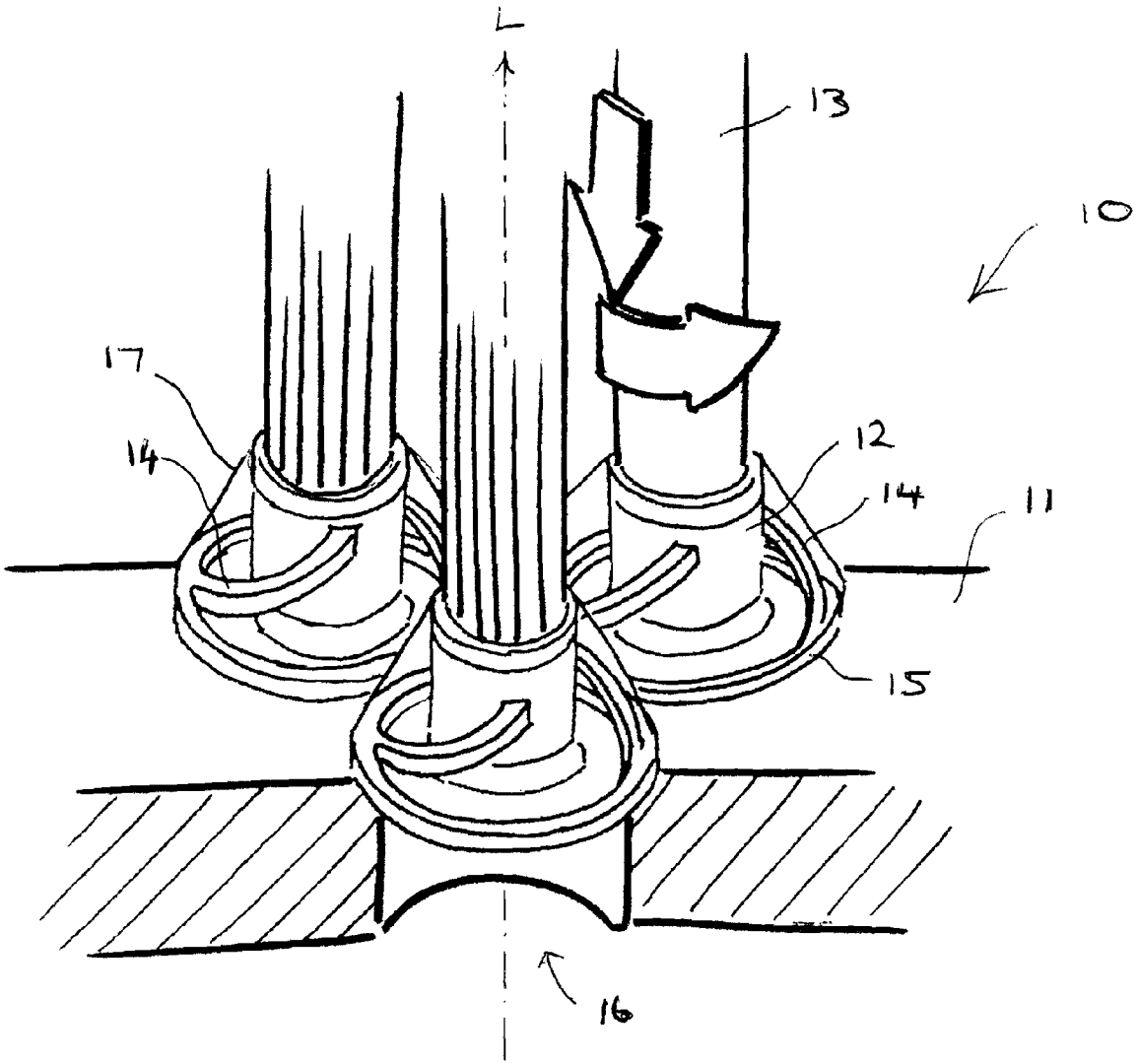
FIG. 1 shows a perspective view of a part of a toothbrush head of this invention.
Figure 2:
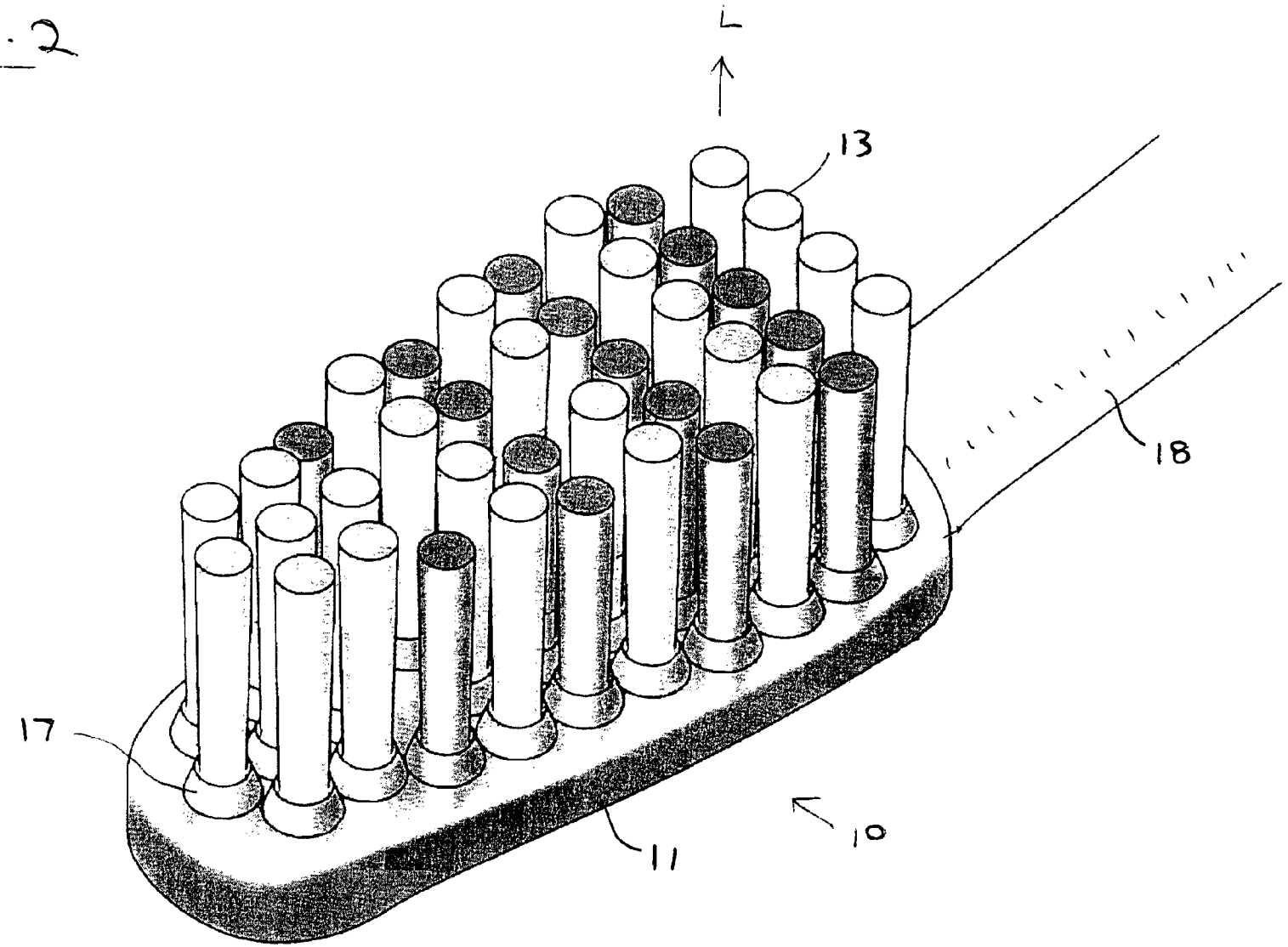
FIG. 2 shows a perspective view of the overall toothbrush head of FIG. 1.

Referring to FIGS. 1 and 2, part of a toothbrush head 10 overall is shown. The head 10 comprises a bristle carrier 11 and plural bristle holders 12 (three are shown, there may be more) each of which holds a tuft 13 of plural bristles. The bristles, and hence the tuft 13 are elongate along a bristle longitudinal direction "L".

Each holder 12 comprises a cylindrical cup made of polypropylene in which the tuft 13 sits and is securely set. The tufts 13 may for example be moulded into the cups 12 or set therein with small metal anchors (not shown) of conventional type.

Each bristle holder 12 is integrally formed with two (there may be more than two) connectors 14. Each connector 14 is in the form of a strip of the polypropylene material elongate in its bristle holder 12 to bristle carrier 11 direction and of narrower width and thickness dimensions across this length direction. The connectors 14 are attached to the holders 12 at positions 180° apart relative to a central longitudinal axis of the tuft 13 parallel to the bristle longitudinal direction "L".

In its holder 12 toward bristle carrier 11 path each connector 14 follows a curved path which is non-radial relative to the central longitudinal axis of the tuft 13 parallel to the bristle longitudinal direction "L", and also relative to the central cylindrical axis of the holder 12. The curved path followed by the connectors 14 is non-radial path relative to the central longitudinal axis of the bristle tuft 13 and holder 12, and follows a conical surface, with an end of the connector 14 connected to the bristle holder 12 being nearer to the apex of the conical surface, and an end of the connector 14 connected to the bristle carrier 11 being nearer to the base of the conical surface. This path approximates to a helix with a twist axis at an acute angle to the bristle longitudinal direction "L".

The connectors 14 are connected integrally to a base 15, integrally made of polypropylene. The base 15 is a circular ring shape centered on the central longitudinal axis of the tuft 13 and holder 12. The base 15 is fixed to the bristle carrier 11.

In the construction shown in FIG. 1 the bristle carrier 11 may be a rigid plastics material, e.g. polypropylene, toothbrush head of generally conventional shape and dimensions. The bases 15, 16 may be fixed to such a bristle carrier 11 by for example welding, by moulding of the bristle carrier 11 around the bases 15, 16, or the bases 15, 16, and consequently the connectors 14 and holders 12 may be integrally made with the bristle carrier 11. Beneath the holders 12 is a cavity 16 in the bristle carrier 11 into which the holders 12 may descend when they move downwardly under pressure applied to the bristles.

The connectors 14 are covered with a layer of an elastic material 17 to prevent the entrance of contamination between the connectors 14. This elastic material 18 may be a thermoplastic elastomer. The cavity 16 may also contain an elastic material, of a sufficient elasticity that the holders 12 can easily move up and down (as seen) against the resilience of this elastic material.

Typically the ring-shaped bases 15 may have a diameter ca. 2-4 times that of a the bristle tuft held in the holder 12. Typical bristle tufts have a diameter ca. 1.0 mm. The height of the truncated conical surface defined by the base and the top surface (as seen) of the holder 12 is ca. 3 mm.

The overall perspective appearance of this toothbrush head 10 is as shown in FIG. 2, in which the overall generally conventional shape of the head is shown; as is the part of the grip handle 18 immediately adjacent to the head 10.

Figure 3:
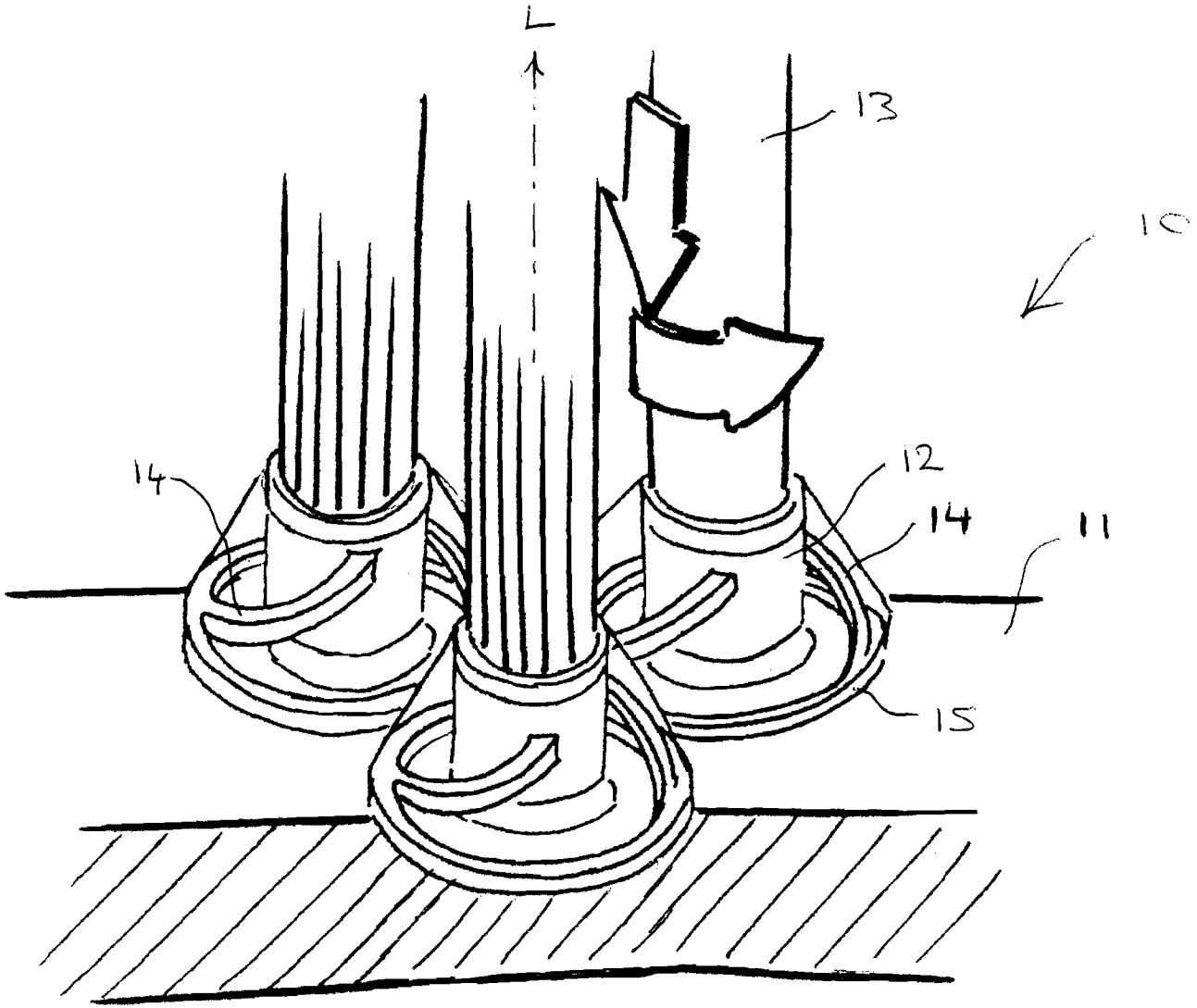
FIG. 3 shows an alternative construction to the head of FIG. 1
Figure 5:
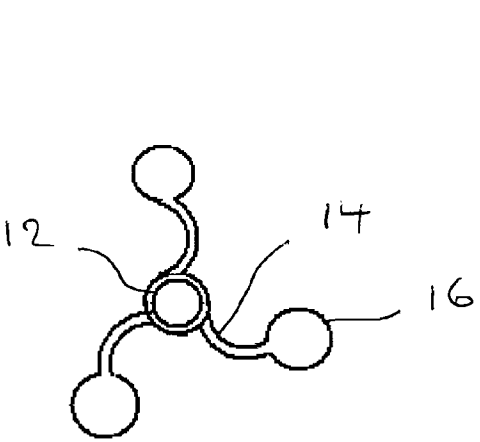
FIG. 5 shows an alternative construction of the bristle holder, connectors, and bristle support of this invention.

In an alternative construction shown in FIG. 3 the bristle carrier 11 is made of a thermoplastic elastomer (TPE) material of the known type which bonds well to the polypropylene of which the integral holder 12, connectors 14 and base 15 are made. In this alternative construction the bristle carrier 11 comprises a pad of this TPE material. The base 15,16, of analogous construction to FIGS. 1 and 5 is embedded in and bonded to the TPE material of the pad adjacent to the upper surface (as seen) of the pad 11, and this TPE material rises above the surface of the carrier 11 in small conical mounds 18 to cover the holders 12 analogously to FIG. 1. The TPE material is sufficiently elastic to allow the embedded holders 12 to move in the manner described above without the need for the cavity 17 of FIG. 1, although such a cavity may be provided. The bristle carrier 11 made of the elastic material is itself supported by a plastics material frame (not shown) of known type e.g. of the type disclosed in WO-A-2005/084486, or the many alternative support means for similar elastic bristle-supporting pads shown in the art.

Figure 4:
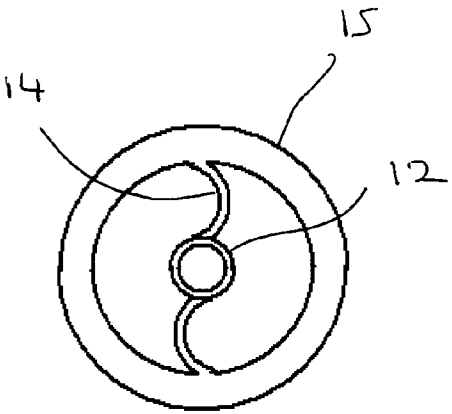
FIG. 4 shows a plan view of a bristle holder, connectors, and bristle support of FIG. 1.

In FIG. 4 a plan view of the holder 12, connectors 14 and base 15 is shown, looking downwardly along the longitudinal bristle direction L. The curved non radial path followed by connectors 12 is seen.

In an alternative construction shown in FIG. 5 the ring shaped base 15 is replaced by an integrally formed foot 16 at the end of each connector 14 remote from holder 12. Three holders 12 and their corresponding feet 16 are shown. The feet 16 can be attached to or made integrally with the bristle carrier 11 of FIG. 1 in a manner analogous to the base 15 of FIG. 1.

Figure 6:
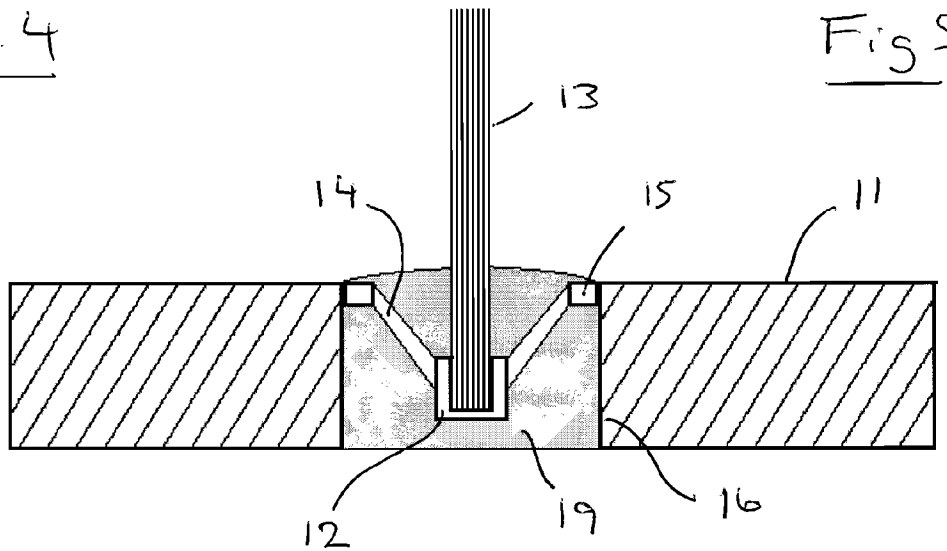
FIG. 6 shows an alternative construction of the bristle holder, connectors, and bristle support of this invention.

FIG. 6 shows a construction analogous to FIG. 1 in which the connectors 14 follow a conical surface which is inverted relative to FIG. 1, corresponding parts being numbered correspondingly. This inverted conical structure can more conveniently fit within cavity 16 in the bristle carrier, which may contain an elastic material 19. The TPE material is sufficiently elastic to allow the embedded holders 12 to move in the manner described above. It is seen that this facilitates a more compact construction in which the holders 12 can be beneath the surface of the bristle carrier 11.

The connectors 14 are resiliently flexible by virtue of the polypropylene material and their dimensions. Tufts 13 are ca. 1 mm id diameter and suitable dimensions will be apparent from this dimension, the dimensions of a typical toothbrush head, and the typical packing density of toothbrush tufts on the surface of a toothbrush head. The curved shape of connectors 12 means that pressure applied to the tuft 13 of bristles in the bristle longitudinal direction L in the direction downwards as seen toward the bristle carrier 11 causes the bristle to move downward toward the bristle carrier 11 in the bristle longitudinal direction L and simultaneously to rotate, anticlockwise as shown in the drawings (or they could rotate clockwise in alternative mirror-image constructions). Subsequent release of the pressure causes the bristle tuft 13 to move reciprocally in the opposite direction, upwards, and simultaneously to rotate, clockwise as shown in the drawings as the tuft returns toward its original position.

The invention claimed is:

1. A toothbrush head which comprises a bristle carrier in the form of a pad of a thermoplastic elastomer material having an upper surface, a bristle holder holding plural bristles, the bristle being elongate along a bristle longitudinal direction perpendicular to the upper surface of the pad and having an upper end relatively distant from the bristle carrier and a lower end relatively nearer to the bristle carrier, the bristle holder being rotatable about a rotation axis parallel to the bristle longitudinal direction by means of plural connectors arranged regularly around the circumference of a circle centered on the rotation axis, the connectors being integrally made of a resilient plastics material with the holder and fixed to the bristle carrier and connecting the bristle holder to the bristle carrier, and which follows a path which is a non-radial path relative to the rotation axis and follows the surface of a cone having its base-apex direction in the bristle longitudinal direction with its apex further from the bristle carrier than the base, with an end of the connector connected to the bristle holder being nearer to the apex of the cone, and an end of the connector connected to the bristle carrier being nearer to the base of the cone, and the end of the connector which is nearer to the apex of the cone being radially closer to the rotation axis than is the end which is nearer to the base of the cone, the connector being resiliently flexible in a direction such that pressure applied to the bristle in the bristle longitudinal direction toward the bristle carrier causes the bristle holder to move against the resilience of the connectors downwards in the bristle longitudinal direction and causes a deformation of the connectors which applies a first torsional force to the bristle holder causing the bristle holder to rotate in a first rotation direction around the rotation axis parallel and subsequent release of the pressure allows the resilience of the connectors to move the bristle holder reciprocally upwards relative to the bristle carrier in the opposite direction, and allows the deformation of the connectors which applies a second torsional force opposite to the first torsional force causing the bristle holder to rotate in a second rotation direction around the rotation axis opposite to the first rotation direction, and wherein the connector is embedded in the thermoplastic elastomer material.

2. A toothbrush head according to claim 1 characterised in that the holder comprises a cup in which a tuft of plural bristle filaments may sit or a sleeve through which a tuft of plural bristle filaments is threaded and is fixed.

3. A toothbrush head according to claim 1 characterized by a connector of a form having a length dimension along the bristle holder-carrier direction, and width and thickness directions perpendicular to this length direction, and width and thickness dimensions less than the length dimension.

4. A toothbrush head according to claim 1 characterized in that the connector(s) is are connected to the bristle carrier by a base connected to the bristle carrier, and the connector(s) connect(s) the bristle holder to the base, so that the connection of the connector(s) to the bristle carrier is via the base.

5. A toothbrush head according to claim 4 characterised in that the base is ring or polygon shaped centered on the bristle central longitudinal axis.

6. A toothbrush head according to claim 1 characterized in that the bristle carrier is made of a rigid plastics material and is connected to a toothbrush handle.

7. A toothbrush head according to claim 6 characterized in that the connector(s) support(s) the bristle holder above a surface of the bristle carrier.

8. A toothbrush head according to claim 7, wherein the bristle holder is covered with a layer of the thermoplastic elastomer material.

9. A toothbrush head according to claim 1 characterized in that there is a cavity in the bristle carrier beneath the bristle holder such that the bristle holder can descend into the cavity as the bristle holder moves toward the bristle carrier in the bristle longitudinal direction.

10. A toothbrush head according to claim 1 characterized in that there is a cavity in the bristle carrier and the bristle holder is mounted within the cavity and the connector(s) connects the holder(s) to the sides of the cavity.

11. A toothbrush provided with a toothbrush head according to claim 1.

* * * * *